US011758952B2

(12) United States Patent
Wesley

(10) Patent No.: US 11,758,952 B2
(45) Date of Patent: Sep. 19, 2023

(54) ADJUSTABLE CUP AND BAND BRALETTE

(71) Applicant: Monica Wesley, New York, NY (US)

(72) Inventor: Monica Wesley, New York, NY (US)

( * ) Notice: Subject to any disclaimer, the term of this patent is extended or adjusted under 35 U.S.C. 154(b) by 53 days.

(21) Appl. No.: 16/951,834

(22) Filed: Nov. 18, 2020

(65) Prior Publication Data

US 2021/0145080 A1 May 20, 2021

Related U.S. Application Data

(60) Provisional application No. 62/936,917, filed on Nov. 18, 2019.

(51) Int. Cl.
*A41C 3/00* (2006.01)
*A41F 1/00* (2006.01)

(52) U.S. Cl.
CPC ..... *A41C 3/0028* (2013.01); *A41F 1/006* (2013.01)

(58) Field of Classification Search
CPC ..... A41F 1/06; A41F 15/00; A41C 3/0028; A41B 9/16
USPC ..... 450/85, 86
See application file for complete search history.

(56) References Cited

U.S. PATENT DOCUMENTS 2,363,017 A * 11/1944 Plehn ..... A41F 1/006 450/86
4,411,269 A * 10/1983 Weintraub ..... A41C 3/02 450/85
7,232,359 B1 * 6/2007 Richardson ..... A41C 3/0028 450/86
9,462,833 B1 * 10/2016 Spaulding ..... A41D 7/005
10,485,270 B2 * 11/2019 Wesley ..... A41C 3/12
2006/0228988 A1 * 10/2006 Weyenberg ..... A41C 3/02 450/58
2020/0337388 A1 * 10/2020 Wilkes ..... A41F 15/002

* cited by examiner

*Primary Examiner* — Gloria M Hale
(74) *Attorney, Agent, or Firm* — Cozen O'Connor

(57) ABSTRACT

An adjustable bralette for supporting breasts of a wearer of the bralette includes: first and second cups each having a pointed top apex and a lower portion having a wraparound support portion; and an adjustable support band. The adjustable support band has: adjustable straps comprising a slidable length adjuster, each of the straps being connected, at one end, to one pointed top apex of one of the cups, and an adjustable length lower support band portion arranged at the lower portion of the first and second cups and wrapping at least partially around the wearer.

9 Claims, 6 Drawing Sheets

ADJUSTABLE CUP AND BAND BRALETTE

CROSS-REFERENCE TO RELATED APPLICATION

This application claims benefit of U.S. Provisional Application No. 62/936,917, filed Nov. 18, 2019, the entire contents of which are incorporated herein by reference.

BACKGROUND OF THE INVENTION

1. Field of the Invention

The present invention relates to wire-free soft brassieres (hereinafter "bras") or "bralettes."

2. Description of the Related Art

Wire-free "soft bras" or "bralettes" address the consumers desire for increased comfort, less stylized "round" shaping, and assist consumers who may either lack an understanding of their true size or may desire to have something wearable if their size continues to change or fluctuate.

One type of conventional bralette is a triangle cup bralette in which each bra cup is attached to a band. Such a bralette is shown in FIG. 1.

A triangle cup bralette 100 includes shoulder straps 102, generally triangular shaped cups 104 and a band 106. Each cup 104 is comprised either of a single piece of fabric to cover each breast or a cup with a dart or seam to provide added projection.

On characteristic of the triangle cup bralette is that each cup 104 is arranged so that the bottom, or base, of the triangle attaches directly to the band 106. This construction eliminates the need for a clearly defined wing or additional seaming at the side and back of the bra. The result is a simple construction that allows for a few cup sizes to be covered with cup 104 made up of a triangular piece of material and supported by band 106.

One disadvantage that arises with this type of bralette 100 is that some wearers report feeling little to no support due to the lack of definition at the side of the cups. Additionally those with larger cup sizes (e.g., C/D and above), may experience insufficient support at the sides of the cups.

Another conventional bralette is a wire-free soft bra having seaming (i.e., seams) very similar to the seaming found in a conventional underwire bra, but without any wire being present. Such a bralette 200 is shown in FIG. 2. Such wire-free (or "wireless") soft bras provide an alternative to wired bras, while maintaining the seaming of a bra having all the same components as a wired bra, other than the wire.

For example, as shown in FIG. 2, the bralette 200 has straps 202, cups 204, wings 205, a band 206, and sometimes a gore (not shown), to define the demarcation between each breast at the center. The defining difference between the bralette 200 and the traditional underwire bra is that there is no wire or "underwire" present.

Because there is no underwire in the design of FIG. 2, the wearer will feel increased comfort. The lack of restriction from a rigid wire being placed under the breasts means that there is nothing pushing against the wearer's sternum or torso, particularly if a gore is present, which would dig in or causing fit issues, such as in the case in which, for example, the wire may poke out at the center or sides of the cup. The presence of seaming in place of a wire provides an added feeling of support.

However, one disadvantage of this design is if the wearer does not fit the defined cup size in the wireless soft bra, the cup will either have excess room, causing it to bag out indicating that the cup is too large, or be too small, resulting in breast spillage over the sides of each cup into the respective wing of the bra, and/or or the bra digging into the breast at the center of the cups.

Another known design is the bra 300 shown in FIG. 3, which has no delineation between the cup and side of the bra. Many bralettes tend to have greater flexibility in being able to address more cup sizes because of the lack of any underwire or seaming that defines a very specific cup size. As with the other designs, the bra includes straps 302. However, in this particular case the material of the cups 304 has little to no delineation from the material that makes up the sides 305 and back of the bra. As a result, the sides and back of the wearer are covered due to the smooth, seamless transition between the cups and the sides and back of the bra.

Women with breasts corresponding to smaller cup sizes can still wear this design because of the lack of definition and delineation between the cup and side of the bra. In addition, women with breasts corresponding to larger cup sizes can also be accommodated with this design due to the fact that while their breast tissue would usually spill out to the sides, for example with a "triangle bra", in the design of FIG. 3 the breasts are covered by the material that make up the sides and back of the bra, and thus will not spill out. The bra of FIG. 3 may also include an elastic band 308 at the bottom for added support underneath the wearer's breasts.

While the aforementioned bralette designs allow for more cup sizes to be covered, they do little to nothing to address the wide variety of band sizes required by the consumer. Although an additional elastic band 308 at the bottom of the bra, as in FIG. 3, adds support, the limited band sizes or lack of band sizes results in the situation in which many wearers will not get their desired support, for example due to bands that are cut wider to try and address as many band sizes as possible in one size.

As seen in FIG. 4, adjustment of the effective band size is achievable in bras using conventional brassiere back clasps 404, 406, including a hooking portion 404 having hooks (hooks not being visible in the figure) and a few rows and columns of receivers/loops 405 on a loop portion 406. By providing multiple rows and columns of the loops, the hooks can be affixed to different ones of the rows of loops providing adjustments of a few inches difference in band size in either direction.

This solution is present on most wired bras and is an appealing feature to many wearers because they are so used to the convenience of not having to pull the bra over their head to take it on and off.

The closely-spaced columns of hooks provides some band-size adjustability by affixing hooks in the first column, second column, and so on of the receivers. However, many wearers find that their size may fluctuate and need these few rows just to have a proper fitting band year round. Additionally as the bra continues to be worn, the elastic in the band begins to lose its recovery, resulting in the band size of the bra being permanently stretched, somewhat defeating the purpose of the adjustment mechanism.

Another solution for the lack of adjustable cup and band sizes is creating different sets of size ranges for different fit needs, for example, "standard sizing" vs. "full bust" sizing." In particular, to address different band sizes, different and separate size ranges may be created for different fit needs. For example, there may be one set of small/medium/large sized bras for addressing "standard" sizes, another set of small/medium/large sized bras for addressing "full bust" sizes, and still another set of sizes addressing "plus sizes" (for those who need a fuller cup and a larger band).

While these designs address many of the issues for more or better fitting band sizes, they need to create two or three times more size variety to provide different sized wearers with a correct or comfortable fit. Additionally, such designs may still try to maximize a few band sizes in one width, which may create less support due to a loose band for some wearers.

A known Kestos bra is shown in front and rear views in FIGS. 5A and 5B. This bra has cups each of which tapers off towards the back and creates an open strap band that wraps around the wearer and clasps in the front. In particular, the Kestos bra 500 includes straps 502, and cups 504. Each cup 504 extends towards the back and tapers off via a tapered portion 505 into a band 506. The band is a continuation of a thin strap 507 that wraps across the back of the wearer and clasps in the front of the bra at connection points 510. While this design may allow for some adjustments in terms of the cup and band size, if adjusters (not shown) are placed on the wrap around straps, a drawback is that the back of the design wraps into the front and features a band that is separate from the cups.

FIGS. 6A and 6B illustrate partial front and partial rear views, respectively, of a type of bra 600 having a defined cup size, but with adjustable horizontal straps making up the band.

This design allows the wearer to adjust several inches in the band size. The cup however has a separate wing 610, underwire 611, or side panel that clearly defines the cup from the side of the wearer. The result is little to no flexibility within the cup size, even with an adjustable band size.

While the conventional wire-free soft bras or bralettes discussed above may allow for a few different sizes (either cup and/or band sizes) to fit into a smaller quantity of sizes (e.g., Small/Medium/Large) they often fail to fit, offer a good fit, and/or provide a desired support level due to poor fit of the bralette overall.

SUMMARY OF THE INVENTION

The invention disclosed herein is a developed solution to the problems associated with traditional rigid underwire, thermoformed support structures, and traditional bralettes and soft bras.

According to one aspect of the present invention, an adjustable bralette for supporting breasts of a wearer of the bralette includes: first and second cups each having a pointed top apex and a lower portion having a wraparound support portion; and an adjustable support band. The adjustable support band has: adjustable straps comprising a slidable length adjuster, each of the straps being connected, at one end, to one pointed top apex of one of the cups, and an adjustable length lower support band portion arranged at the lower portion of the first and second cups and wrapping at least partially around the wearer.

In another aspect, the adjustable straps comprise a shoulder strap portion adapted to be worn over the shoulders of the wearer.

In another aspect, each of the shoulder strap portions is connected to the top pointed apex of each of the cups.

In another aspect, the lower support band portion is adjustable by a sliding adjuster.

In another aspect, the shoulder strap portions are connected to one another in a region of a back of the wearer.

In another aspect, the shoulder strap portions are configured to separately extend vertically down the back of the wearer such that each shoulder strap portion connects to the lower support band portion.

In another aspect, the lower support band portion comprises plural bands.

In another aspect, the lower support band portion extends from at least one wraparound support portion.

In another aspect, the lower support band portion comprises a break at the back of the wearer and is length adjustable by hook and loop connection between two ends of the break.

In another aspect, the lower support band portion comprises a break at the back of the wearer and connects together by a coupling mechanism.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The above and/or other aspects and advantages will become more apparent and more readily appreciated from the following detailed description of the disclosed embodiments taken in conjunction with the accompanying drawings in which.

DETAILED DESCRIPTION OF THE PRESENTLY PREFERRED EMBODIMENTS

Figure 7A:
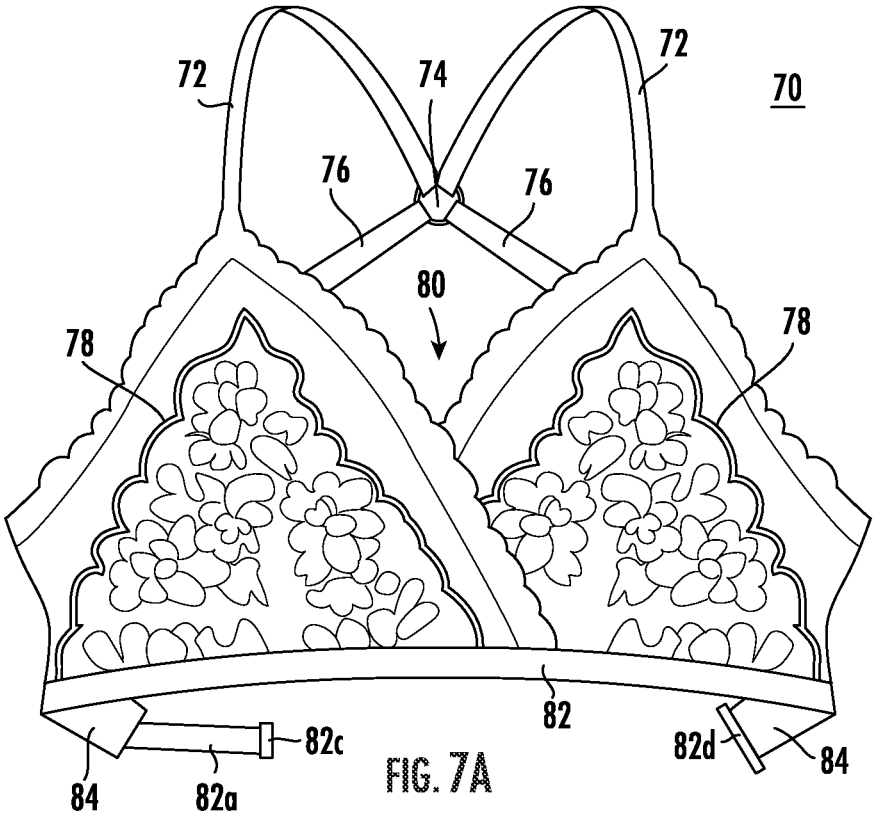
FIGS. 7A and 7B are views of a bralette according to a first embodiment of the present invention.
Figure 7B:
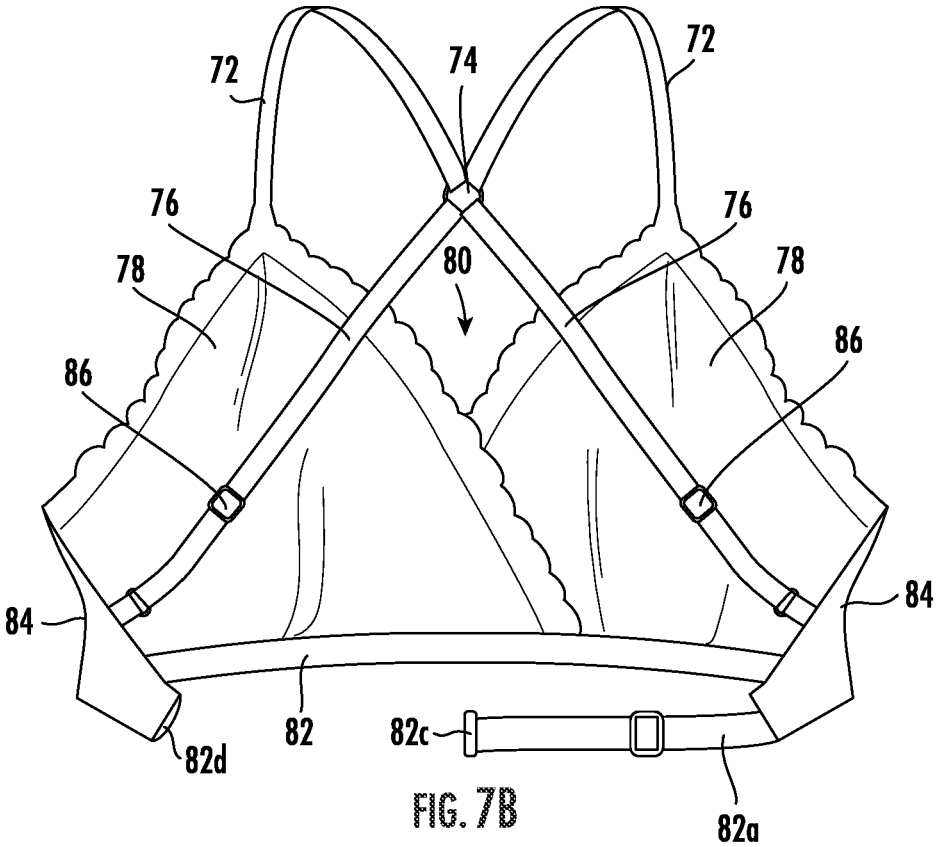
Figure 8A:
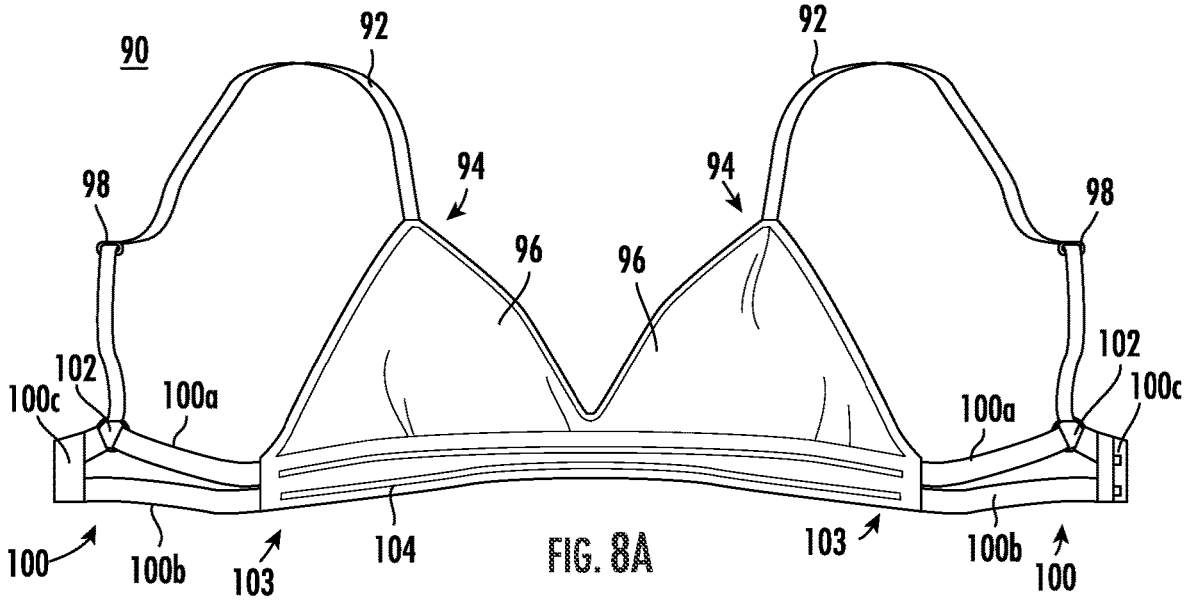
FIGS. 8A and 8B are views of a bralette according to a second embodiment of the present invention.
Figure 8B:
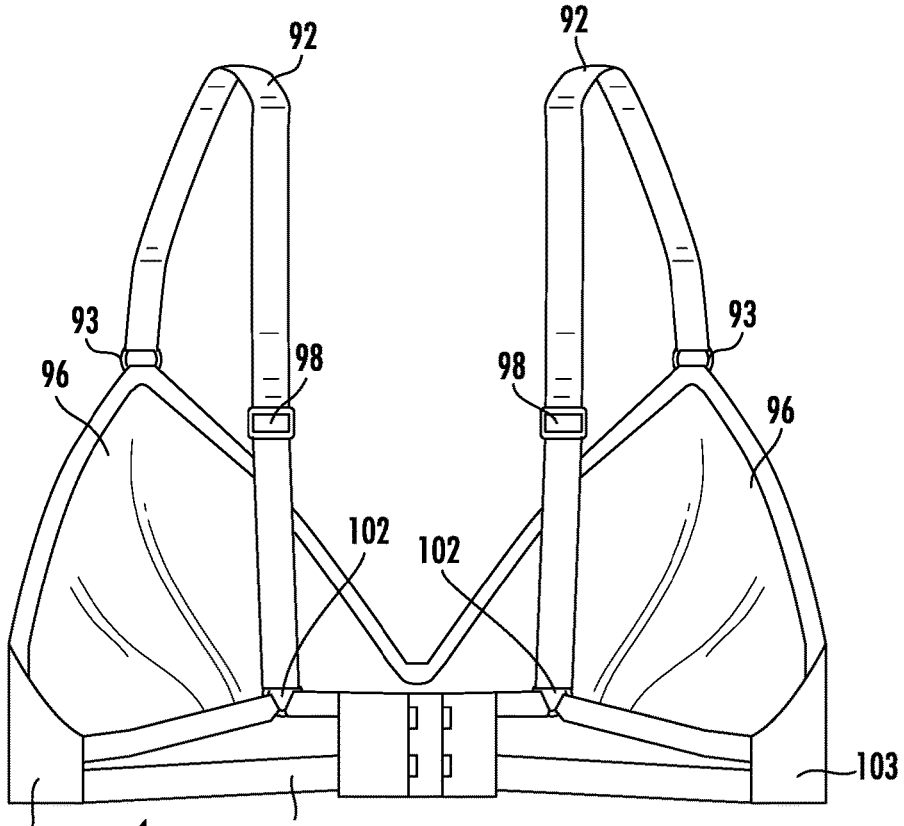

FIGS. 7A and 7B illustrate a first embodiment of the invention disclosed herein, and FIGS. 8A and 8B illustrate a second embodiment of the invention. Each embodiment represents an improved bra, specifically a bralette, that addresses the problems associated with conventional rigid underwire, thermoformed support structures, and conventional bralettes and soft bras. The invention being disclosed consists, in each embodiment, of a cup or separate cups each of which extends towards the back of the wearer and tapers off to connects to an adjustable band.

In each embodiment, the cups cover, contain, and support the wearer's breasts. Also, as will be developed in the description of each embodiment, in each instance each cup extends beyond the wearer's sides and tapers off towards the wearer's back. This allows for more coverage at the underarm of the wearer, or coverage of breast tissue in case of larger breast size. This extension of the cup allows for more breast sizes to be served, whether smaller or larger, within the same or fewer number of cup sizes.

Also, in each embodiment, an adjustable band is provided that extends from the cups across the wearer's back.

As can be seen in FIGS. 7A and 7B, the bralette 70 in accordance with the first embodiment, has straps. For the purposes of this disclosure, the term "band" will be used in some contexts to refer to the combination of the straps and the horizontally extending band structure.

The straps comprise a shoulder strap portion 72, a coupler 74, and a back strap portion 76. As can be seen in FIGS. 7A and 7B, the straps connect the upper point of the cups 78 to a counterpart cup extension 84 in the other, i.e., counterpart cup. For instance, the shoulder strap portion 72 that originates at the top of the right cup, after passing through the coupler 74, becomes the back strap portion 76 that connects to the cup extension 84 of the left cup, and vice versa.

Alternatively, squared off ring coupler 74 can be used, in which case the back strap portions 76 each originate at the coupler 74 and each shoulder strap portion 72 terminates at the squared off ring coupler 74.

As can be seen in the figures, each cup has an extension 84 that provides side support to the breasts, especially in a case in which a wearer has larger breasts, e.g., at the high end of breast sizes that can be accommodated by the bralette. Moreover, in a preferred aspect, the cups overlap one another at the lower portion of the bralette to provide additional support in the middle of the wearer's breast. As an alternative, instead of the cups overlapping as shown in FIGS. 7A and 7B, a seam could be included that has approximately the same height as the overlap to provide similar support.

In the first embodiment, the lower portion 82 of the band begins from the bottom of the outer edges of the cups 78 and extends past the wearer's sides and across the wearer's back, as can be seen in FIGS. 7A and 7B. The extra portion 82*a* can be connected to a connector on the extension 84 on the cup at the other side of the bralette 70.

The band of the bralette in accordance with the first embodiment is fully adjustable, comprising the set of straps 72, 76 adjustable with the use of sliders 86 or other similar components. By virtue of the sliders and adjustable straps, if the band is too long, in effect the fit is too loose, the wearer will not feel sufficient support and, by use of the sliders 86, the wearer can tighten the band straps until the most comfortable amount of support is achieved. On the other hand, if the band is too short, i.e., the fit is too tight, the wearer can adjust the band straps making them longer so the bra fits better and the straps do not dig into the wearer.

The lower band portion 82 extends past the end of the extension 84 on one cup, and terminates at a connection (extra) portion 82*a*, which has a connector 82*c* with can engage a corresponding connector 82*d* that is attached to the extension 84 on the other cup.

Figure 1:
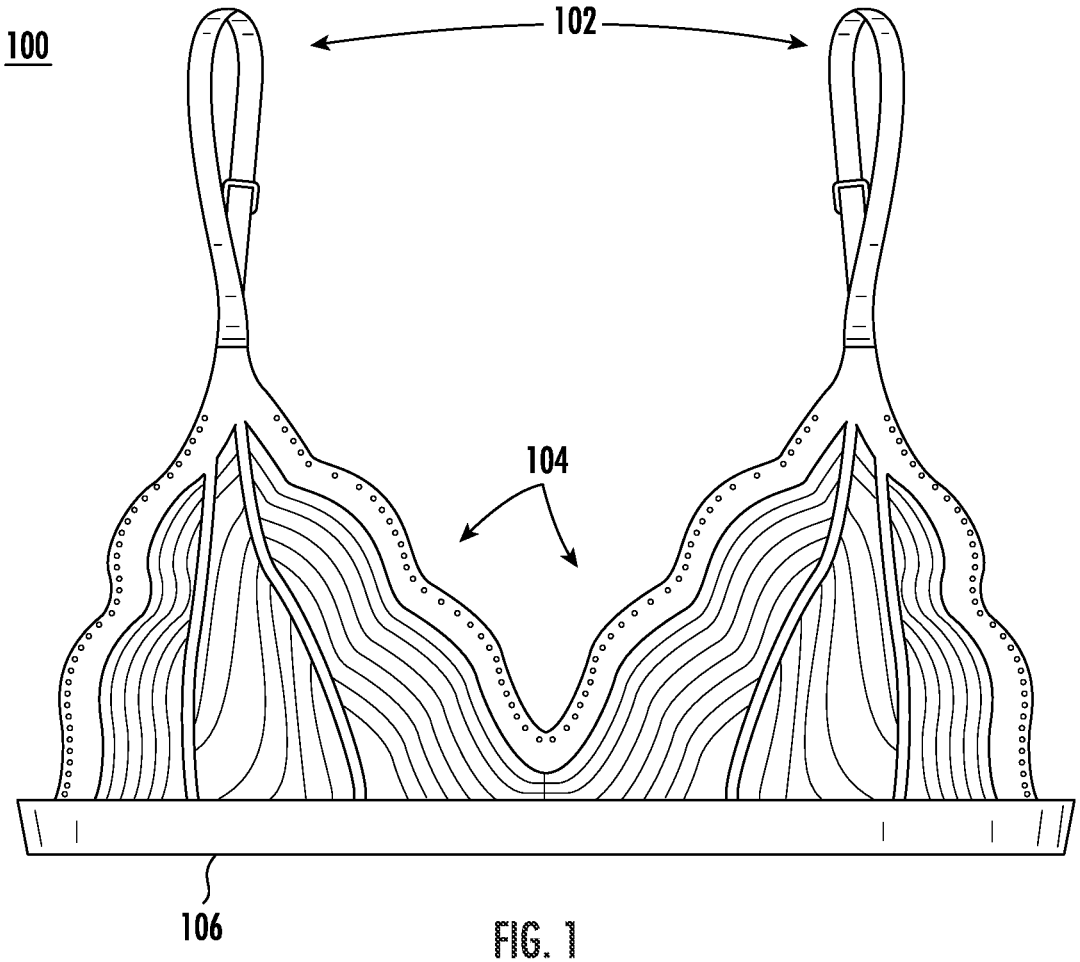
FIG. 1 PRIOR ART
FIG. 1 shows a conventional triangle cup bralette.
Figure 2:
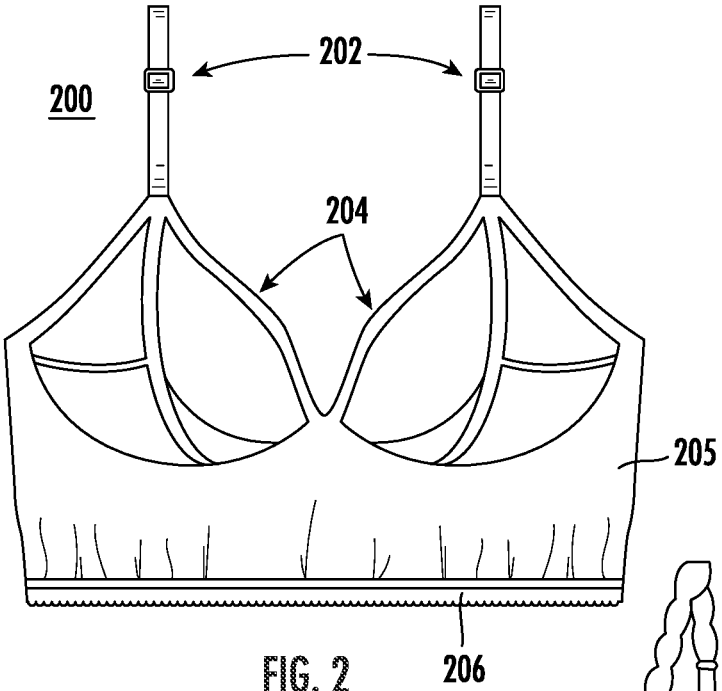
FIG. 2 PRIOR ART
FIG. 2 shows a conventional wireless soft bralette.
Figure 3:
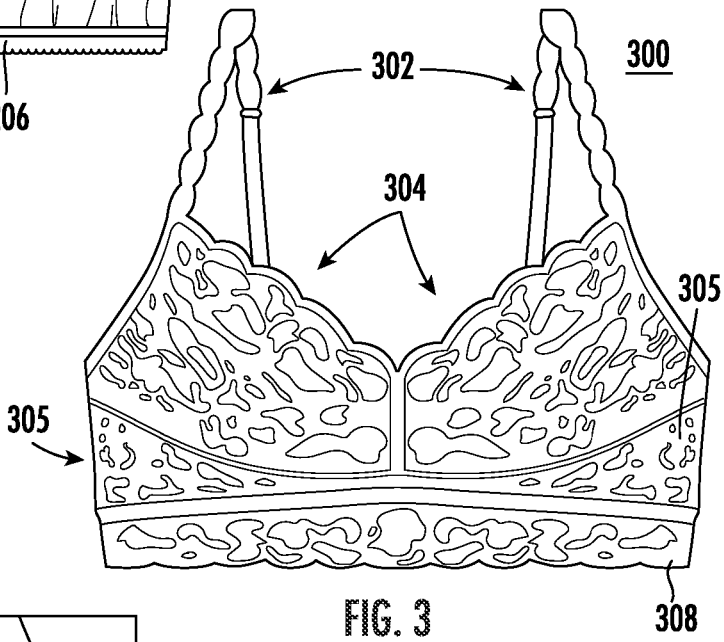
FIG. 3 PRIOR ART
FIG. 3 shows a conventional bra with no delineation between the cup and side of the bra.
Figure 4:
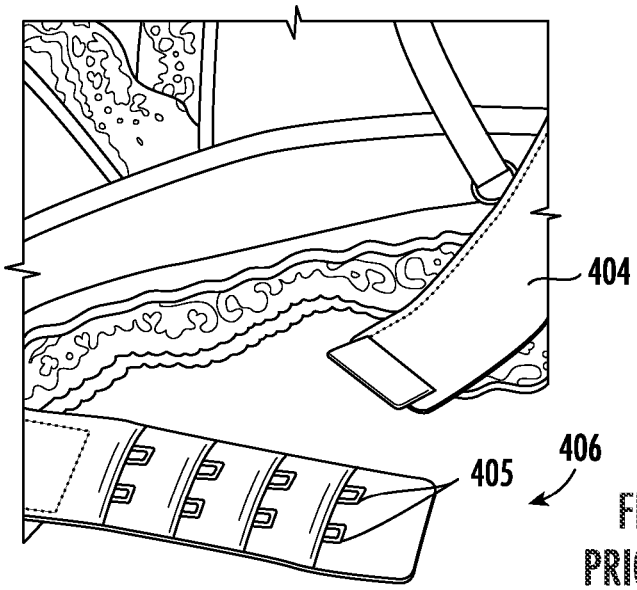
FIG. 4 PRIOR ART
FIG. 4 shows conventional hook and loop brassiere back clasps.
Figure 5A:
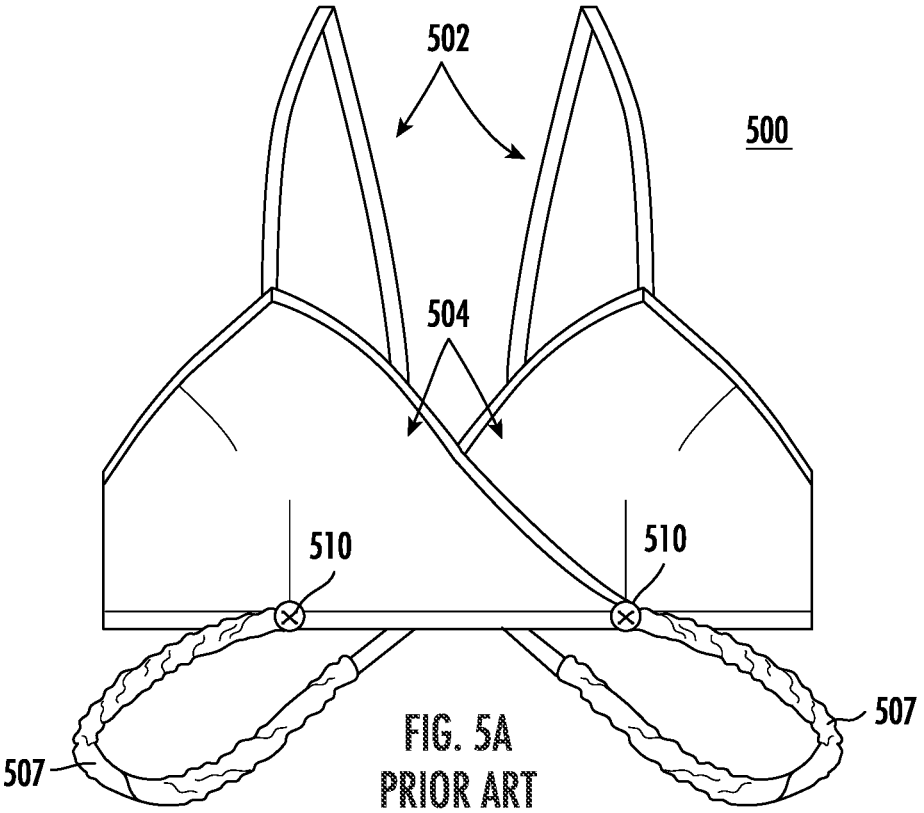
FIG. 5A PRIOR ART
FIGS. 5A and 5B are views of another conventional bra design.
Figure 5B:
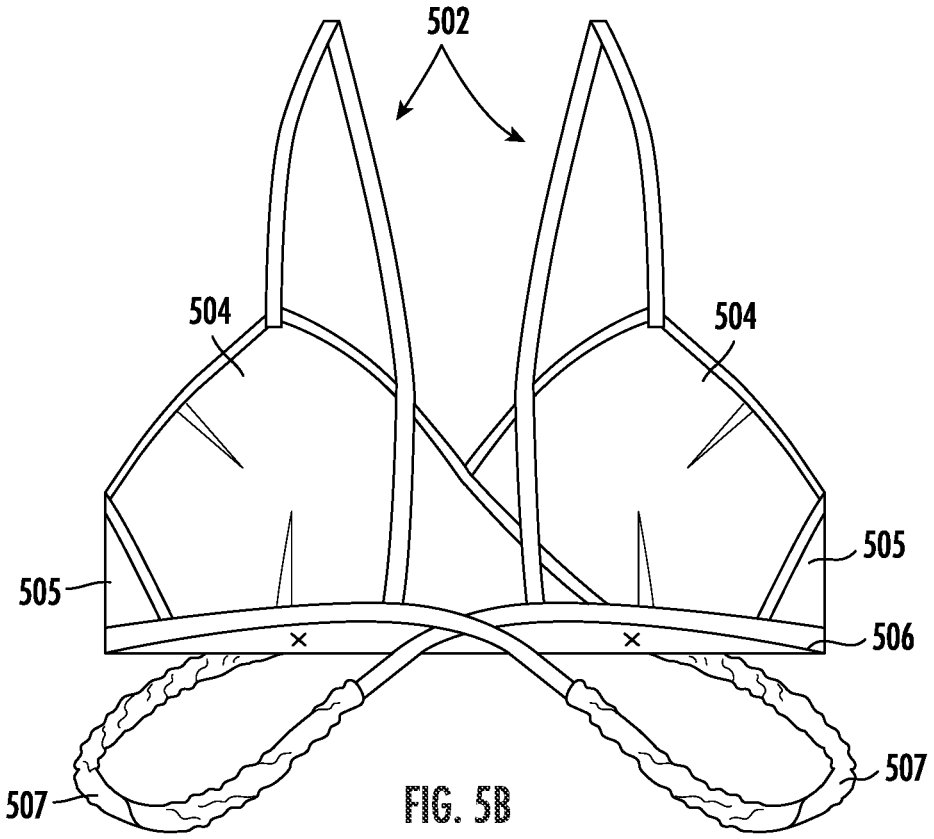
FIG. 5B PRIOR ART
Figure 6A:
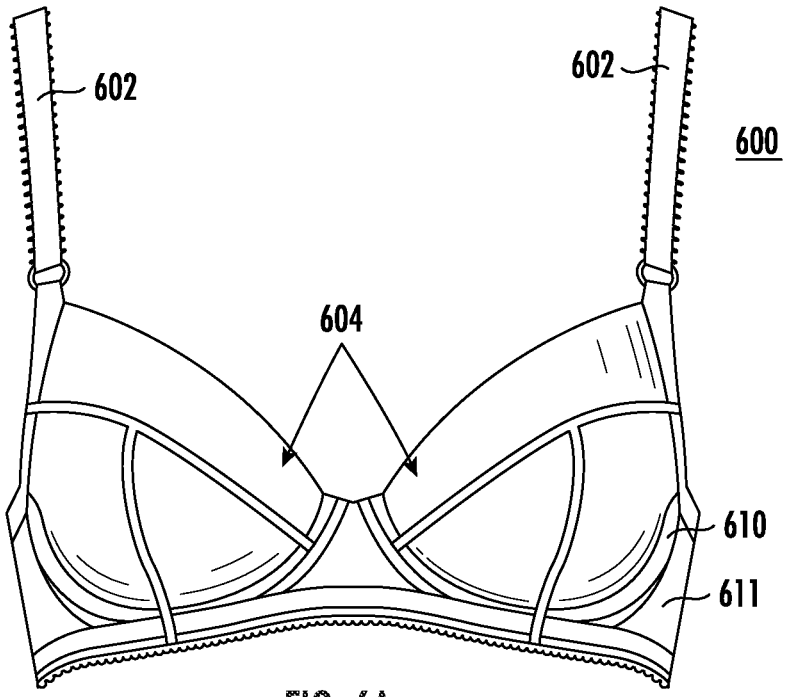
FIG. 6A PRIOR ART
FIGS. 6A and 6B are views of yet another conventional bra design.
Figure 6B:
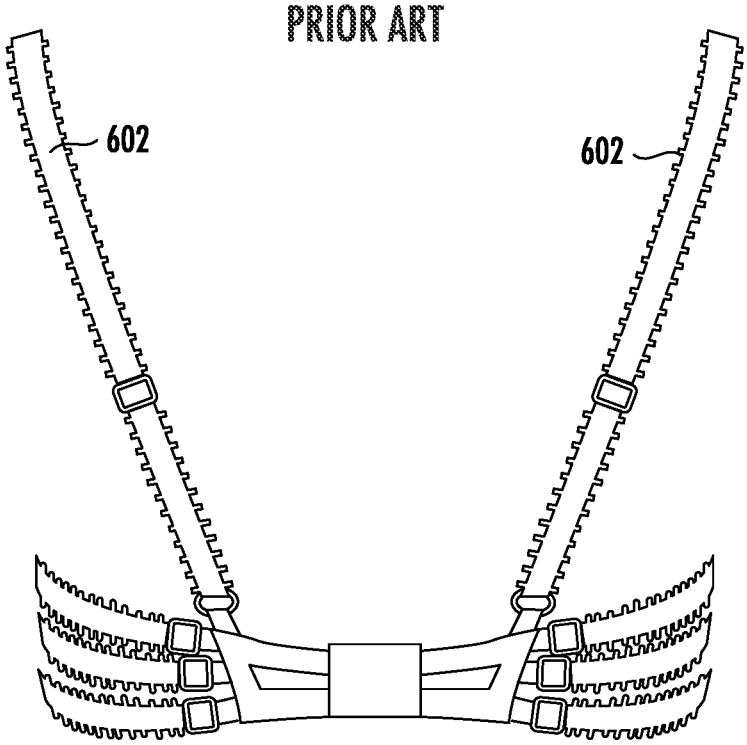
FIG. 6B PRIOR ART

Thus, the band of the first embodiment is fully adjustable by the straps that are adjustable with the use of the sliders 86. Adjustability is not limited to the use of sliders and can be achieved using other similar components. The purpose of the band is to allow the cups to stay in place on the body and add support in addition to that of the cups. For the band to provide comfortable support, it needs to be snug without being too tight. Typically with existing bras there is either no adjustment available at the back of the bra or only a few columns of hooks and eyes (FIG. 4). This by itself, not combined with any other adjustable back features, does little to accommodate a wide variety of wearer back sizes.

The second embodiment bralette 90 is illustrated in FIGS. 8A and 8B and has shoulder strap portions 92 affixed by respective connector rings 93 to the top region/point 94 of each respective triangular cup 96. In this embodiment, the shoulder strap portions 92 descend vertically after passing over the wearer's shoulders. In the rear, the shoulder straps terminate by engaging a ring coupler 102 that allows the shoulder strap portions to attach to the rear multi-strap lower band 100, which has a upper band 100*a* and a lower band 100*b*. Also, the shoulder straps 92 are adjustable via sliding adjusters 98. The upper and lower bands 100*a*, 100*b* each terminate in a connector portion 100*c*, which may, for example, together form a hook and loop adjustable bra connector of the type shown in FIG. 4.

As in the first embodiment, the lower outer corners of the cups 96 end in folded back portions 103, which provide side support to the sides of the breast, especially in the case in which the wearer's breasts are at the upper end of the breast sizes supported by the bralette.

As illustrated in FIGS. 8A and 8B, the adjustable band of the bralette comprises additional sets of straps/bands, e.g., bands 100*a* and 100*b*, that are also adjustable, giving the wearer additional points of support.

In both embodiments, the purpose of the band, which includes the straps, is to allow the cups to stay in place on the body and add support in addition to that provided by the cups. For the band to provide comfortable support, it needs to be snug without being too tight. Typically with prior art bras there is either no adjustment available at the back of the bra or only a few columns of hooks and eyes. This by itself, without being combined with the inventive adjustable back features and side features of the first and second embodiments, does little to accommodate a wide variety of wearer back sizes.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An adjustable bralette for supporting breasts of a wearer of the bralette, the bralette comprising:

first and second triangular cups each having an upper point;

first and second cup extensions from the first and second triangular cups, respectively, around a side of the wearer;

adjustable lower band extending from the first and second cup extensions across the wearer's back;

first and second shoulder straps extending from the upper point of the first and second triangular cups across the wearer's shoulders to a ring coupler;

first and second adjustable straps comprising a slidable length adjuster at a back region of the wearer, each of the straps being connected, at one end, to the ring coupler and at the other end, to the first or second cup extension, respectively; and a connector positioned on the adjustable lower bands at the back region of the wearer and configured to engage the respective adjustable lower bands together.

2. The bralette according to claim 1, wherein the adjustable lower bands are adjustable by a sliding adjuster.

3. The bralette according to claim 1, wherein the first and second adjustable straps are connected to one another by the ring coupler at the back region of the wearer.

4. The bralette according to claim 1, wherein the adjustable lower bands extend from at least one of the first and second cup extensions.

5. An adjustable bralette for supporting breasts of a wearer of the bralette, the bralette comprising:

first and second triangular cups each having a pointed top apex and a lower portion having a wraparound support portion;

an adjustable support band, the adjustable support band having:

adjustable straps comprising a slidable length adjuster at a back region of the wearer, each of the straps being connected, at a first end, to one pointed top apex of one of the triangular cups, and an adjustable length lower support band portions arranged at the lower portion of the first and second triangular cups, extending from each wraparound support portion to meet at the back region, and wrapping at least partially around the wearer, each of the adjustable length lower support band portions further comprising an upper band and a lower band, and a ring coupler attaching each of the adjustable straps at a second end to a respective upper band;

a connector terminating the upper band and the lower band of each of the adjustable length lower support band portions at the back region of the wearer and configured to engage the respective wraparound support portion of the first and second triangular cups together.

6. The bralette according to claim 5, wherein the adjustable straps comprise shoulder strap portions adapted to be worn over shoulders of the wearer.

7. The bralette according to claim 6, wherein the shoulder strap portions are configured to separately extend vertically down the back region of the wearer such that each shoulder strap portion connects to the lower support band portion.

8. The bralette according to claim 5 wherein the connector comprises a break at the back region of the wearer and is length adjustable by hook and loop connection between two ends of the break.

9. The bralette according to claim 5 wherein the adjustable support band further comprises a coupler for engaging the adjustable straps and the upper band of the adjustable length lower support band portion together.

* * * * *